US006833675B2

(12) United States Patent
Gordin

(10) Patent No.: US 6,833,675 B2
(45) Date of Patent: Dec. 21, 2004

(54) METHOD AND APPARATUS OF BLOCKING ULTRAVIOLET RADIATION FROM ARC TUBES

(75) Inventor: Myron K. Gordin, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 10/310,407

(22) Filed: Dec. 5, 2002

(65) Prior Publication Data

US 2003/0094890 A1 May 22, 2003

Related U.S. Application Data

(63) Continuation of application No. 09/076,277, filed on May 12, 1998, now abandoned.

(51) Int. Cl.[7] ..... H01J 61/35; H01J 61/38; H01J 9/00

(52) U.S. Cl. ..... 313/635; 313/489; 313/580; 313/634; 313/112; 313/110; 313/113; 445/22; 445/26

(58) Field of Search ..... 313/110, 112, 313/113, 489, 635

(56) References Cited

U.S. PATENT DOCUMENTS

| | | | | |
|---|---|---|---|---|
| 1,814,326 A | | 7/1931 | Melton | |
| 2,228,329 A | | 1/1941 | Reynolds | |
| 2,280,640 A | | 4/1942 | Shockey | |
| 2,520,445 A | | 8/1950 | Sposler | |
| 2,821,393 A | | 1/1958 | Hoppe | |
| 3,099,403 A | | 7/1963 | Starwick | |
| 3,231,733 A | | 1/1966 | Ohnemus | |
| 3,511,983 A | | 5/1970 | Dorman | |
| 3,586,851 A | | 6/1971 | Rudolph | |
| 3,686,495 A | | 8/1972 | Medley | |
| 4,087,682 A | | 5/1978 | Kolodziej | |
| 4,345,178 A | | 8/1982 | Pappas et al. | |
| 4,607,191 A | * | 8/1986 | Flaherty | 313/489 |
| 4,663,698 A | | 5/1987 | Tomlinson | |
| 4,712,167 A | | 12/1987 | Gordin et al. | |
| 4,725,934 A | | 2/1988 | Gordin | |
| 4,747,033 A | | 5/1988 | Yasuda | |
| 4,799,963 A | | 1/1989 | Basil et al. | |
| 4,809,147 A | | 2/1989 | Negishi | |
| 4,816,974 A | | 3/1989 | Gordin | |
| 4,866,327 A | | 9/1989 | Fischer et al. | |
| 4,868,727 A | | 9/1989 | Ponds et al. | |
| 4,890,208 A | | 12/1989 | Izenour | |
| 4,891,739 A | | 1/1990 | Yasuda | |
| 4,947,303 A | | 8/1990 | Gordin et al. | |
| 5,016,150 A | | 5/1991 | Gordin et al. | |
| 5,059,865 A | * | 10/1991 | Bergman et al. | 313/113 |
| 5,075,828 A | | 12/1991 | Gordin et al. | |
| 5,119,275 A | | 6/1992 | Makita | |
| 5,134,550 A | | 7/1992 | Young | |
| 5,134,557 A | | 7/1992 | Gordin et al. | |
| 5,161,883 A | | 11/1992 | Gordin et al. | |
| 5,211,473 A | | 5/1993 | Gordin et al. | |

(List continued on next page.)

FOREIGN PATENT DOCUMENTS

| | | |
|---|---|---|
| CH | 415840 | 1/1967 |
| DE | 35 36 583 A1 | 4/1986 |
| DE | 34 47 136 A1 | 6/1986 |
| DE | 37 11 568 A1 | 10/1988 |
| EP | 0 389 408 A1 | 9/1990 |
| EP | 1 037 245 A2 | 9/2000 |
| US | 862073 | 3/1961 |
| WO | WO 94/15143 | 7/1994 |

*Primary Examiner*—Nimeshkumar D. Patel
*Assistant Examiner*—Mariceli Santiago
(74) *Attorney, Agent, or Firm*—McKee, Voorhees & Sease, P.L.C.

(57) ABSTRACT

An apparatus and method for blocking ultraviolet radiation from a arc tube includes a coating placed on at least a portion of the arc tube to block the UV radiation but yet pass visible light from the arc tube.

19 Claims, 3 Drawing Sheets

U.S. PATENT DOCUMENTS 5,214,345 A * 5/1993 Saito et al. ..... 313/635
5,229,681 A 7/1993 Gordin et al.
5,402,327 A 3/1995 Gordin et al.
5,510,964 A 4/1996 Spitler et al.
5,535,111 A * 7/1996 Wedell ..... 313/113
5,541,471 A 7/1996 Terheijden et al.
5,552,671 A * 9/1996 Parham et al. ..... 313/635
5,572,091 A * 11/1996 Langer et al. ..... 313/636
5,595,440 A 1/1997 Gordin et al.
5,608,227 A 3/1997 Dierks et al.
5,647,661 A 7/1997 Gordin
5,691,601 A 11/1997 Frey et al.
5,707,142 A 1/1998 Gordin
5,800,048 A 9/1998 Gordin
5,816,691 A 10/1998 Gordin et al.
5,952,768 A 9/1999 Strok et al.
6,107,742 A * 8/2000 Seki et al. ..... 313/637

* cited by examiner

METHOD AND APPARATUS OF BLOCKING ULTRAVIOLET RADIATION FROM ARC TUBES

"This is a continuation application from U.S. Ser. No. 09/076,277 filed May 12, 1998 now abandoned."

BACKGROUND OF THE INVENTION

1. Field of the Invention

The present invention relates to ways to block ultra violet (UV) radiation from high intensity light sources such as arc tubes, and in particular, an apparatus and method of blocking UV radiation at or near the light source.

2. Problems in the Art

The use of and applications for high intensity light sources continues to increase. One example is wide area lighting, such as for lighting sports fields or arenas.

A popular type of high intensity light source in use today is referred to as a metal halide source. A arc tube comprising literally a tube made of, for example, quartz, includes two electrodes entering opposite ends of the arc tube. As is well-known in the art, certain chemicals are inserted into the arc tube and it is sealed.

By providing electrical power to the electrodes, the chemical make-up of the interior of the arc tube results in the emission of light.

While such a light source can provide a very high intensity of light for its size and for the power consumed to generate such light, one problem or concern is that such light includes an ultraviolet component. Ultraviolet light can be harmful to humans. Because such arc tubes can be used to produce an intense source of light, this is a very real concern.

Rules and regulations have been developed by the industry addressing this problem. Examples of presently used solutions are as follows.

A glass jacket can be placed around the arc tube. For reasons known in the art, regular glass (as opposed to the high temperature quartz glass used for the arc tube) has properties which block UV radiation, or at least a substantial part of it, whereas quartz such as used with the arc tube does not. Thus, this what will be called "regular glass" effectively acts as a filter for UV radiation. When associated with a jacket around the arc tube, at a sufficient distance that the heat from the arc tube will not materially affect the jacket, such glass blocks UV radiation from the light source. Although such solutions are relatively inexpensive, it increases the structural complexity of the light source and the manufacturing process. There are more things subject to failure.

Also, a subtle but important point is that a glass jacket increases the overall size of the light source. As is appreciated in the art, it is generally true that the bigger the physical size of the light, the bigger the physical size of the fixture must be. The converse is also many times true. As can be further appreciated, it is generally advantageous to minimize the size of lighting fixtures. Smaller size usually means less materials and less manufacturing costs. Particularly in outdoor applications, such as outdoor wide area lighting of sport fields, a smaller physical fixture size reduces the wind drag or wind load on the fixture.

Furthermore, it should be understood that jacketed arc tubes create glare problems not created by non-jacketed arc tubes. Any time light passes through glass, there is some reflection. Therefore, some of the light generated by an arc tube would reflect off the jacket wall. This causes the jacket to glow, which in turn presents a larger source of glare when the interior of the fixture is viewed.

Another solution to the problem of UV light from an arc tube uses regular glass in the lens of the light fixture as a UV filter. The advantage of this system is that it eliminates the need for the jacket around the arc tube. The size of the light source can then be smaller which can be very useful in lighting applications.

Each of the above solutions has further deficiencies or problems, however. Utilization of the jacket to filter UV light is beneficial because if the lens to the fixture is opened with the light on, UV radiation would continue to be blocked. If the lens only is used as the UV filter, one who opens the lens (a conventional way to access the interior of many fixtures), would then be exposed to UV radiation.

However, if the lens to the fixture is broken, UV radiation would emanate from the fixture if the light source is on. Moreover, in situations where a UV filter is associated with a jacket around the arc tube, if the jacket breaks or is removed, UV radiation may be a problem.

Therefore, certain additional precautions have been made with many lighting fixtures in the industry. In particular, many fixtures which utilize an arc tube without a jacket, but rely on the lens to block UV, have safety switches or components that cut power to the arc tube if either the lens is opened or the lens breaks. This adds complexity and cost to the fixture. Also, the safety provided by such power disconnect components is only as good as the reliability of the system and the components. Over time they may degrade and malfunction.

Heretofore, no one is known to have placed a UV filter directly on the arc tube. Because of the high temperatures of such high intensity arc tubes, it is difficult to make any substance adhere, at least for substantial periods of time.

There is therefore a need for an improvement in the arc regarding this issue.

It is therefore principal object of the present invention to provide an apparatus and method for blocking ultraviolet radiation from high intensity arc tubes which solves the problems or improves over the deficiencies in the arc. Further objects, features, and advantages of the invention include:

1. An apparatus and method which block ultraviolet radiation from arc tubes at all times.
2. An apparatus and method which eliminate the need for jackets around arc tubes.
3. An apparatus and method which eliminate one need for safety switches or power cut-offs.
4. An apparatus and method which make it possible to utilize high intensity arc tube light sources of the smallest possible physical dimensions in the fixture and can allow reduction is size of the entire fixture.
5. An apparatus and method which is durable and economical.

These and other objects, features, and advantages of the present invention will be become more apparent with reference to the accompanying specification and claims.

SUMMARY OF THE INVENTION

The present invention is an apparatus and method for blocking UV radiation from high intensity arc tubes. The method of the invention includes placing an ultraviolet filter coating directly on the arc tube. The coating effectively blocks or filters at least a substantial amount of the UV radiation generated by such an arc tube and yet passes a substantial amount of useable light from the light source.

The apparatus of the invention includes an arc tube having a body of a certain size. The coating can be placed on part of or all of the arc tube envelope. The light source therefore has a physical size which is essentially the same as the arc tube.

DETAILED DESCRIPTION OF PREFERRED EMBODIMENT

Overview

Figure 1:
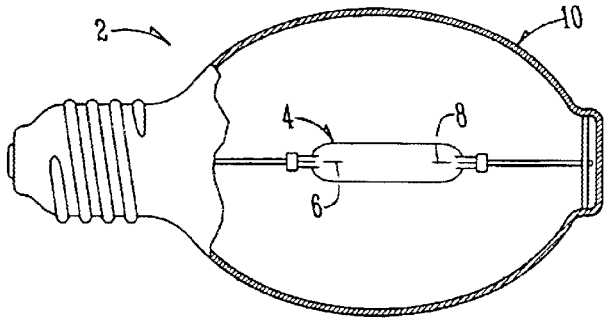
Fig. 1 (Prior Art)
FIG. 1 is a cross-sectional view of a jacketed arc tube according to one example of prior art methods of blocking UV radiation from arc tubes by jacketing the arc tube with glass.

For a better understanding of the invention, one preferred embodiment will be described in detail here. Reference will be taken from time to time to the drawings. Reference numerals will indicate certain parts and locations in the drawings. The same reference numerals will be used to indicate the same parts and locations throughout the drawings, unless otherwise indicated.

In this preferred embodiment, the environment of use of the invention will be with respect to high intensity wide area lighting fixtures, such as those used in sports lighting or automobile race track lighting. Additionally, the type of light source discussed is a metal halide arc tube light source such as are known in the art.

FIG. 1 illustrates one prior art method of a high intensity arc tube 4 as a light source 2 which has UV filtering capabilities. A metal halide arc tube 4 includes a tubular quartz body 4 which sealingly encases adjacent ends of electrodes 6 and 8. As is well-known in the art, such a arc tube, operating for the purpose of wide area lighting, would have a substantial amount of electricity applied to it and build up considerable levels of heat. Temperatures on the order of 1800° Fahrenheit are reached during operation of such arc tubes.

Because the quartz does not effectively filter most of the ultraviolet radiation, the prior art method is to encase the arc tube 4 with an outer jacket of regular glass 10. The space between outer jacket 10 and arc tube 4 serves to provide sufficient temperature insulation that regular glass can be used and high temperature glass or quartz is not needed. Jacket 10 would therefore filter UV radiation, as discussed previously. Electrodes 6 and 8 are extended to distal ends 12 and 14 which then can be connected to an electrical power source (not shown) such as is known in the art.

Figure 2:
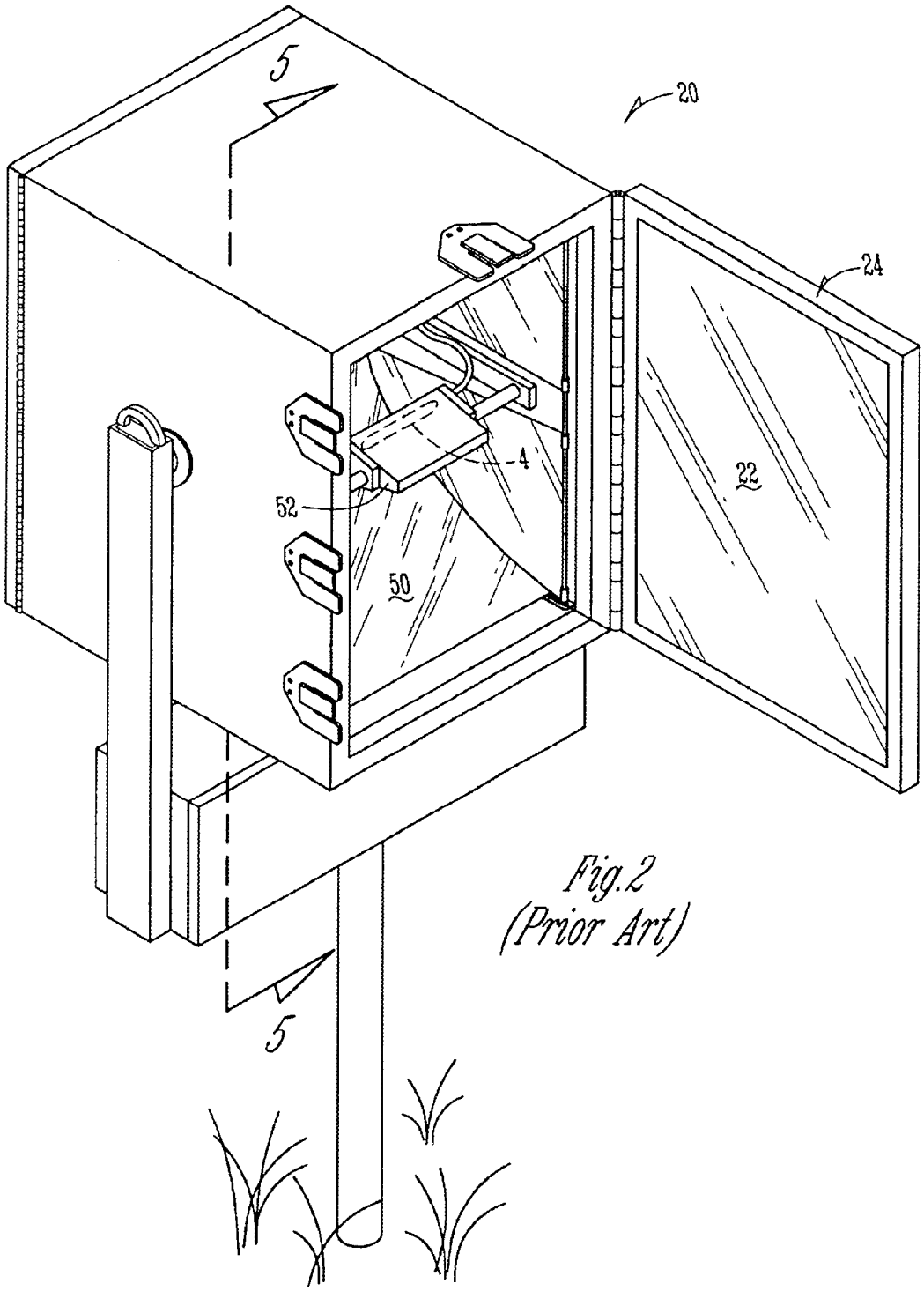
Fig.2 (Prior Art)
FIG. 2 is in perspective view of a high intensity lighting fixture using an arc tube, illustrating a removable glass lens.

FIG. 2 illustrates a lighting fixture that can utilize an unjacketed metal halide arc tube 4. The specifics of such a fixture are disclosed in detail in U.S. Pat. No. 5,647,661, issued Jul. 15, 1997 to the owner of the present application. That patent is incorporated by reference herein regarding the specific details of fixture 20. As is shown in FIG. 2, fixture 20 includes a regular glass lens 22 in a hinged door 24 at the front of fixture 20. As noted previously, one other prior art method of blocking UV radiation when using an unjacketed arc tube in a light fixture, would be to rely on glass lens 22. As mentioned before, however, if the door 24 is open, or lens 22 is broken, the UV blockage is removed.

Therefore, as also previously mentioned, many fixtures using high intensity discharge arc tubes of this type have electrical components and circuits that automatically disconnect the power if lens 22 is broken or door 24 is opened. These systems are widely known in the art and are not further described here. This could involve contactors and/or switches or other structures.

It has been noted, and is relevant with respect to FIG. 2, however, that in certain uses it is beneficial to have the light source as physically small as possible. This allows more flexibility and options with regard to the optic system for wide scale lighting fixtures. One way to reduce physical fixture size is to reduce physical size of the light source. An unjacketed arc tube is quite small relative to a jacketed arc tube. It does, however, require some method of blocking UV radiation, usually at the door or lens.

Figure 3:
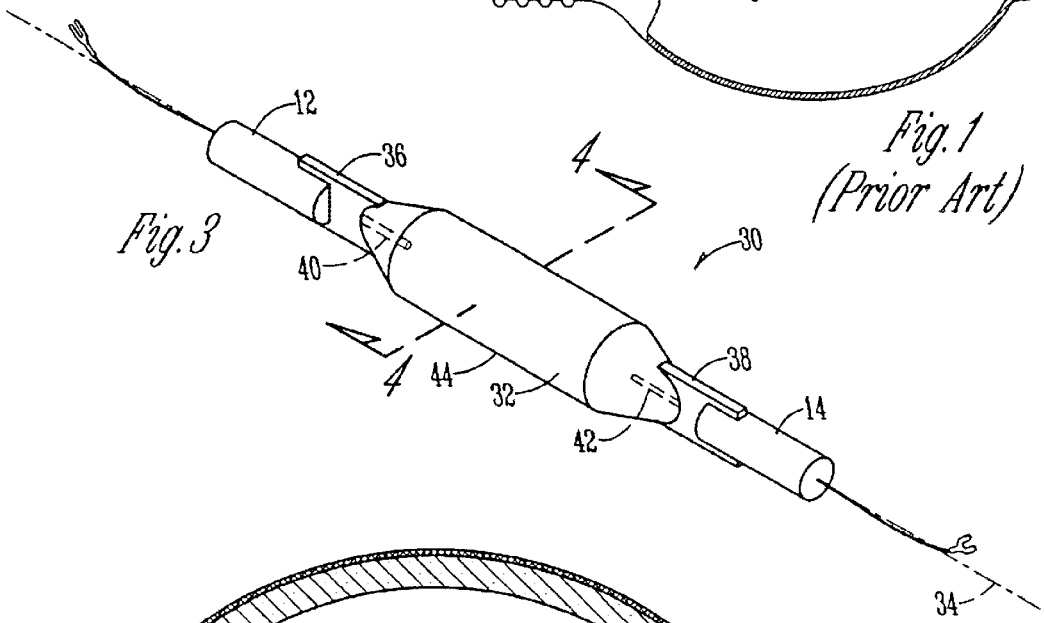
FIG. 3 is a perspective view of a preferred embodiment of the present invention.

FIG. 3 shows light source 30, according to preferred embodiment of the present invention. Light source 30 includes an arc tube body 32 elongated along an axis 34. Opposite ends 36 and 38 are sealed down upon electrodes 40 and 42, which have adjacent ends inside the body 32 and opposite ends outside of body 32.

A coating 44 (e.g. a thin film dielectric) is adhered to the exterior of body 32. Coating 44 blocks a substantial amount of UV radiation created upon operation of light source 30, but passes a substantial part of the visible light spectrum that is used for wide scale lighting purposes. Coating 44 is essentially invisible to the eye.

Figure 4:
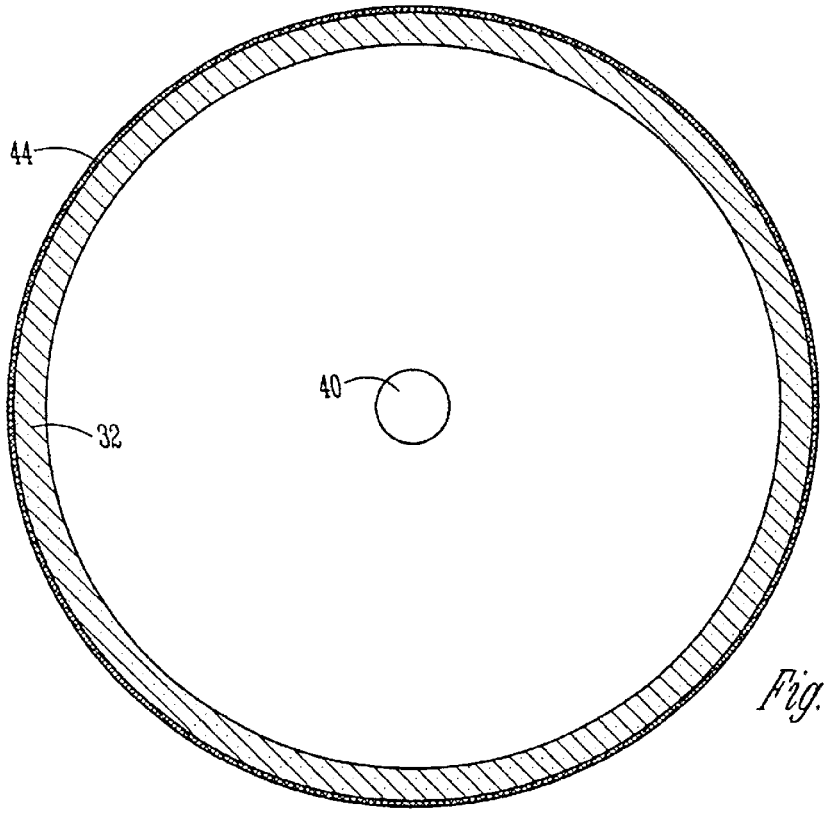
FIG. 4 is a cross-sectional view taken along line 4—4 of FIG. 3.

FIG. 4 shows in cross-section the light source 30 of FIG. 3. It is to be understood that FIG. 4 shows coating 44 out of proportion to illustrate it. Coating 44 is on the order of four (4) microns thick. Coating 44 could be completely over arc tube body 32 so that no light energy from inside body 32 leaves without being filtered by coating 44. On the other hand, coating 44 could be applied only in selected areas. For example, most of the light energy emanates radially from the middle of light source 30 relative to a plane that is orthogonal to axis 34. There may be little or no need, therefore, for a coating over the opposite ends 36 and 38 of light source 30.

Figure 5:
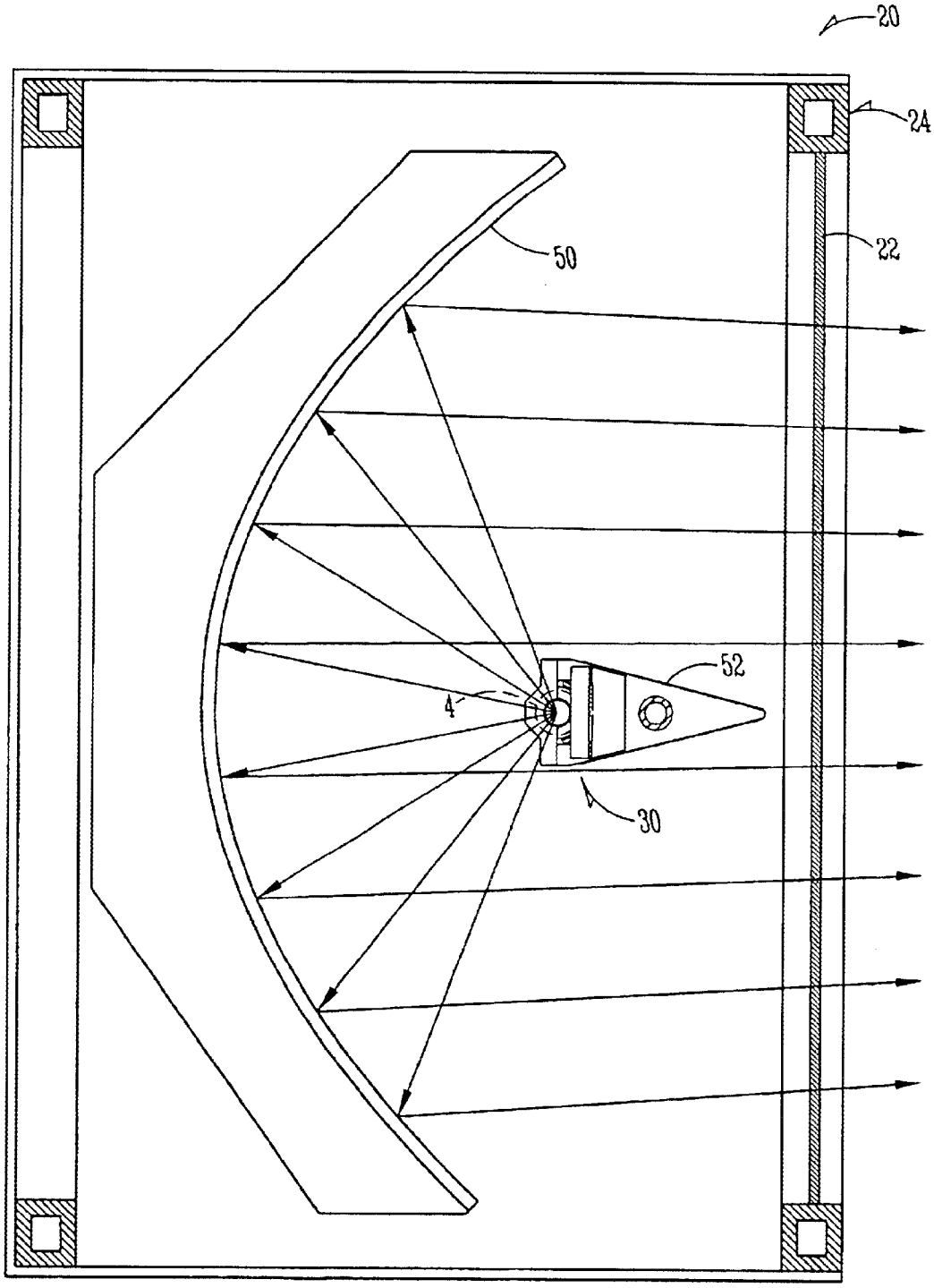
FIG. 5 is a diagrammatic view of an elevational cross-section such as would be taken along line 5—5 of FIG. 2.

FIG. 5 illustrates diagrammatically in elevational cross-section, the use of light source 30 in a light fixture such as fixture 20 of FIG. 2. A support member 52 would hold light source 30 in position suspended inside fixture 20. A reflecting surface 50 would be created relative to the size, shape, and characteristics of light source 30, to best utilize light output of light source 30. The lens 22 would cover the exit opening for light generated by light source 30 and collected and re-directed by reflecting surface 50.

As can be appreciated, and as is well-known in the lighting field, there are advantages to having the light source as small as possible in physical size. By utilizing light source 30, with a UV coating directly on the arc tube body 32, the physical size of light source 30 is essentially the same as a conventional arc tube. Moreover, complete reliance on lens 22 for UV blockage is not needed. Finally, automatic power disconnects, upon breakage of lens 22 or opening of door 24, are not needed with regard to UV protection.

Coating 44 is made from rare earth oxides and is applied to arc tube envelope 32 by a microwave enhanced plasma sputtering technique. One such method is the proprietary MICRODYN® process available from Deposition Sciences, a company in Santa Rosa, Calif.

The essential characteristics of coating 44 are that it is substantially transparent to visible light and substantially non-transparent to UV light. It is adhered to arc tube body 32 and is designed to stay adhered for the life of arc tube 30 without separation or burning off over time.

Physical dimensions of coating 44 are as follows. Coating 44 is placed over the entire outer surface of arc tube body 32. Coating 44 is on the order of four (4) microns thick (in one embodiment). Coating 44 blocks approximately 99% plus of ultraviolet radiation from the arc tube. It also passes approximately 95% (nominal) of visible light.

It will be appreciated that the included preferred embodiment is given by way of example only, and not by way of limitation to the invention, which is solely described by the claims herein. Variations obvious to one skilled in the art would be included within the invention defined by the claims.

For example, the preferred embodiment is discussed with regard to a metal halide arc tube light source. Other high intensity discharge arc lamps might benefit from the invention.

What is claimed is:

1. An improved high intensity discharge arc tube adapted to operate at a power rating of approximately 500 watts or greater for wide area lighting and adapted to be removably mounted in a reflector of a lighting fixture having a removable glass lens comprising;

an unjacketed tubular quartz arc tube body including first and second electrodes, the body elongated along an axis;

a coating adhered to the body, the coating being substantially transmissive of visible light energy but substantially blocking ultraviolet light energy from the body, the coating comprising a thin film dielectric comprised of rare earth oxide.

2. The arc tube of claim 1 wherein the high intensity discharge arc tube comprises a metal halide arc tube.

3. The arc tube of claim 1 wherein the body is made of quartz glass.

4. The arc tube of claim 1 wherein the coating is applied to substantial portion of the arc tube body.

5. The arc tube of claim 1 wherein the coating is applied to substantially the entire arc tube body.

6. A method of blocking ultraviolet radiation created by a light source adapted to operate at a power rating of approximately 500 watts or greater for wide area lighting and adapted to be removably mounted in a reflector of a lighting fixture having a removable glass lens comprising an unjacketed high intensity discharge arc quartz tube, while minimizing the physical size of the light source comprising:

generating light from the arc tube;

blocking substantially all ultraviolet light with a UV block at or very near the arc tube, the UV block being on the same order of size as the arc tube or smaller, the block comprising a thin film dielectric comprising rare earth oxide.

7. The method of claim 6 wherein the UV block comprises a UV blocking layer on the exterior of the arc tube.

8. The method of claim 7 wherein the layer blocks 99% of UV light but passes over 90% of visible light.

9. A high intensity lighting fixture for wide area lighting comprising:

a reflector;

a light source adapted to operate at a power rating of approximately 500 watts or greater and adapted to be removably mounted in a reflector of a lighting fixture having a removable glass lens comprising a quartz unjacketed high intensity discharge arc tube mounted in the reflector;

a UV block on the same order of size of the arc tube or smaller positioned on or adjacent the are tube and adapted to block UV radiation from emanating from substantially any part of the arc tube, wherein the arc tube has a body made of quartz glass;

the UV block comprising a coating adhered to the body, the coating being transmissive of a substantial amount of visible light energy but blocking at least a substantial amount of ultraviolet light energy; and the coating comprising a thin film dielectric comprising rare earth oxide;

physical size of the reflector minimized relative to physical size of the light source because of lack of a jacket around the arc tube, which allows minimization of physical size of the lighting fixture.

10. The fixture of claim 9 wherein the arc tube comprises a high intensity discharge metal halide arc tube.

11. The fixture of claim 9 wherein the coating is applied to at least a portion of the body of the arc tube.

12. The fixture of claim 9 wherein the coating is applied to a majority of the arc tube body.

13. The fixture of claim 9 further comprising a glass lens in front of the reflector.

14. The fixture of claim 9 wherein the fixture has no components which automatically disconnect electrical power to the fixture upon opening or breakage of the lens.

15. A method of producing a high intensity, controlled wide area light beam and blocking ultraviolet radiation created by an unjacketed high intensity discharge arc tube adapted to operate at a power rating of approximately 500 watts or greater and adapted to be removably mounted in a reflector of a lighting fixture having a removable glass lens, while minimizing the physical size of the light source, reflector, and lighting fixture comprising:

positioning an UV block on or adjacent the unjacketed arc tube, the UV block being on the same order of size as the arc tube or smaller, the arc tube being adapted to block UV radiation from emanating from substantially any part of the arc tube, the block comprising a thin film dielectric comprising rare earth oxide; and minimizing physical size of the reflector relative to physical size of the light source because of lack of a jacket around the arc tube, to minimize physical size of the lighting fixture; and operatively positioning the arc tube in a reflector.

16. The method of claim 15 wherein the UV block comprises a UV blocking layer on the exterior of the arc tube.

17. The method of claim 15 comprising placing the reflector and arc tube inside a housing, the reflector and housing being scaled to be minimized relative to the size of the arc tube.

18. The method of claim 15 further comprising placing a glass lens in front of the reflector.

19. The method of claim 18 wherein the fixture has no components which automatically disconnect electrical power to the fixture upon opening or breakage of the lens.

* * * * *